US005970878A

United States Patent [19]

Gardner

[11] Patent Number: 5,970,878

[45] Date of Patent: Oct. 26, 1999

[54] UNIVERSAL SHOT WAD

[75] Inventor: Robert J. Gardner, Bethalto, Ill.

[73] Assignee: Olin Corporation, East Alton, Ill.

[21] Appl. No.: 08/991,096

[22] Filed: Dec. 15, 1997

[51] Int. Cl.[6] ..... F42B 7/08

[52] U.S. Cl. ..... 102/449; 102/532

[58] Field of Search ..... 102/448–463, 102/532

[56] References Cited

U.S. PATENT DOCUMENTS

| | | | |
|---|---|---|---|
| 308,941 | 12/1884 | Yates . | |
| 553,062 | 1/1896 | Follett . | |
| 1,830,913 | 11/1931 | Segee . | |
| 2,144,232 | 1/1939 | Spengler . | |
| 2,582,125 | 1/1952 | Holmes . | |
| 3,221,658 | 12/1965 | Devaux . | |
| 3,368,489 | 2/1968 | Herter . | |
| 3,420,178 | 1/1969 | Rempel | 102/453 |
| 3,568,603 | 3/1971 | Vartanian | 102/453 |
| 3,614,929 | 10/1971 | Herter et al. . | |
| 3,673,965 | 7/1972 | Herter . | |
| 3,721,197 | 3/1973 | Hughes et al. . | |
| 3,730,095 | 5/1973 | Lage . | |
| 3,786,753 | 1/1974 | Eckstein et al. . | |
| 3,788,224 | 1/1974 | Merritt | 102/450 |
| 3,835,783 | 9/1974 | Curran | 102/451 |
| 3,974,770 | 8/1976 | Clark, Jr. | 102/451 |
| 4,004,522 | 1/1977 | Furniss et al. . | |
| 4,290,365 | 9/1981 | Dreyer . | |
| 4,479,438 | 10/1984 | Bilsbury . | |
| 4,627,356 | 12/1986 | Buczkowski | 102/532 |
| 4,679,505 | 7/1987 | Reed . | |
| 4,733,613 | 3/1988 | Bilsbury et al. . | |
| 5,239,928 | 8/1993 | Ricci . | |
| 5,347,932 | 9/1994 | Gardner et al. . | |
| 5,361,700 | 11/1994 | Carbone . | |
| 5,861,572 | 1/1999 | Schuermann | 102/449 |

FOREIGN PATENT DOCUMENTS

| | | | |
|---|---|---|---|
| 1045395 | 11/1953 | France . | |
| 1186659 | 8/1959 | France | 102/449 |
| 6184 | 8/1879 | Germany . | |
| 471351 | 1/1929 | Germany . | |
| 353154 | 10/1937 | Italy . | |
| 593153 | 5/1959 | Italy . | |
| 1124236 | 8/1968 | United Kingdom | 102/448 |

OTHER PUBLICATIONS

"Winchester Ammunition 1997 Ballistics Guide" product literature. ©1997 Winchester/Olin Corporation, East Alton, Illinois 62024.

*Primary Examiner*—Harold J. Tudor
*Attorney, Agent, or Firm*—Gregory S. Rosenblatt; William B. Slate; Wiggin & Dana

[57] ABSTRACT

The combination of a shot sleeve and a shot cup base form a universal shot wad that precisely fixes an adjustable volume for the shot column of a wide range of shot shell loads. The shot sleeve is a generally tubular member with an open end and a closed end. The inside of the shot sleeve is substantially smooth adjacent to both the open end and the closed end and has a plurality of substantially parallel, inwardly projecting, first ribs circumscribing the inside between the smooth portions.

The shot cup base is a second tubular member and also has an open end and a closed end. A plurality of substantially parallel, outwardly protruding, second ribs circumscribe an outside of the shot cup base. The volume of a shot receiving portion is controlled by inserting the shot cup base a desired distance into the shot sleeve such that the two sets of ribs interengage. Apertures formed through the shot cup base cause the sidewall portions of the shot cup base to segment and open outward on expulsion from the muzzle of a shotgun increasing aerodynamic resistance. The increased aerodynamic resistance causes the shot cup base to separate from the shot string minimizing interference of the shot flight pattern by the shot cup base.

23 Claims, 8 Drawing Sheets

UNIVERSAL SHOT WAD

BACKGROUND OF THE INVENTION

1. Field of the Invention

This invention relates to a universal shot wad that provides precise control of an adjustable volume available for the shot columns of a wide range of shot shell loads. More particularly, the combination of an adjustable shot cup base interengaged with a shot sleeve provides the desired volume. Apertures extending through the sides of the shot cup base cause sidewall portions to flare outwardly when expelled from a shotgun muzzle. The flared sidewall portions increase aerodynamic resistance of the shot cup base causing the shot cup base to rapidly separate from the shot string thereby minimizing disruption of the shot flight pattern.

2. Description of Related Art

Shot shells containing shot to be expelled from a shotgun have a hollow cylindrical, typically plastic, husk sealed by a base cap at one end and a crimp at the other end. Contained within the shot shell are a powder charge adjacent to the base cap, a plurality of shot adjacent to the crimp, and a shot wad separating the shot from the powder charge. Conventional shot wads consist of three parts: a powder cup, a shot cup and a compressible section between the powder and shot cups.

The powder cup retains the powder charge confined within the shot shell load and seals the gasses generated on powder ignition. Efficient gas sealing is important to achieve consistent load velocity and pressure performance. The shot cup encapsulates the shot column to protect the gun barrel as the shot column travels down the bore. The compressible section of the shot wad provides an element of adjustibility in the wad to accominodate variations in shot size, powder charge weights and/or density and to provide a snug load fit. On firing, the compressible section collapses to increase the available volume for expanding gases. This reduces the peak pressure required to achieve a specified velocity.

A shot receiving portion volume is usually sized to a specific shot weight for a limited range of shot sizes. Multiple shot wads of different sizes are required for the wide range of commercial loads and shot weights. While this approach is effective, it is also expensive.

U.S. Pat. No. 2,144,232, that is incorporated by reference in its entirety herein, discloses annular grooves on an inside wall of the husk at the open end, opposite the base cap. After shot are loaded, a closure disk engages one of the annular grooves retaining the shot.

Another approach, disclosed in U.S. Pat. No. 3,730,095 to Lage, that is incorporated by reference in its entirety herein, discloses a shot cup having deformable legs that contact an over powder cup. When shot are loaded into the shot receiving portion, the open end of the husk is crimped to form a seal over the shot. The legs of the shot cup deform as necessary to provide a snug fit for the shot.

U.S. Pat. No. 3,788,224, that is incorporated by reference in its entirety herein, discloses a multiple piece adjustable wad system having a powder cup with a collapsible post and a series of shot cups with fixed volumes. This adjustable wad system provides a means to compensate for the variability of powder density, powder charge weight and shot weight. The system has the disadvantage of requiring a large number of components for a wide range of loads. For example, in 12 gauge 2¾ inch loads, this wad system would require six different shot cups, in addition to the powder cup, to accommodate a shot weight range of from ⅞ ounce—1⅝ ounces. As described below, the present invention accommodates the same weight range with a two piece system.

In another approach, a shot sleeve is slit in four locations to form flexible sidewall portions and then inserted into the shot shell. The length of the slits is to the desired location of the bottom of the inserted shot cup base. The shot sleeve is a tubular member having an open end adjacent to the open end of the shot shell and a closed end forming the powder cup. The inside wall of the shot sleeve is substantially smooth adjacent to both the open end and the closed end and contains a plurality of substantially parallel, inwardly projecting, first ribs circumscribing the inside wall between the two smooth portions. A cylindrical shot cup base having a ribbed outer surface that interengages the ribs of the shot sleeve is then inserted to a desired depth to form a shot receiving portion shot cup of the appropriate volume.

This "universal" shot wad provides a very effective fit for a wide range of loads. On firing, the shot cup sleeve and shot cup base are expelled from the shotgun muzzle with the shot. The slit shot sleeve petals open increasing the aerodynamic resistance causing the shot sleeve to rapidly drop away from the shot string.

The cylindrical shot cup base, having less aerodynamic drag than the sleeve, travels with the shot string for a longer distance and tends to interfere with shot flight pattern. In lower shot weight loads, such from ⅞ ounce to 1⅛ ounces, the volume of the shot column captured within the shot cup base is a relatively large proportion of the total shot column. Therefore, any adverse influence by the shot cup base on the shot string is more pronounced in these light weights.

While it is known to form longitudinally running slits in shot cups to cause sidewall portions to petal open when the shot cup is expelled from the muzzle of a shotgun increasing aerodynamic resistance and causing the shot cup to lag behind the shot string, as disclosed in U.S. Pat. No. 5,361,700 to Carbone, presently utilized longitudinal slits are suitable for the shot sleeve, but not for the shot cup base. In the universal shot wad, the shot cup base is inserted with considerable force into the shot sleeve to interengage with the ribs of the shot sleeve. Longitudinal slits, as presently known in the art, significantly weaken the strength of the shot cup base sidewalls causing them to be prone to distortion when inserted into the shot sleeve and interfering with proper interengagement between the shot sleeve and the shot cup base. Also, longitudinal slits do not provide sufficient flexibility for the short sidewalls of the shot cup base.

There remains, therefore, a need for a shot cup base suitable for use with a ribbed shot sleeve that provides sufficient aerodynamic resistance so as not to interfere with the shot string that, further, is sufficiently robust to withstand handling and engagement with a ribbed shot sleeve.

SUMMARY OF THE INVENTION

Accordingly, it is an object of the invention to provide a shot cup base for use with a shot sleeve that has a combination of aerodynamic resistance and robustness. It is a feature of the invention that the shot sleeve has an inside wall with a ribbed central portion. Another feature of the invention is that the shot cup base has ribs on an outside surface thereof that interengage with the ribbed central portion of the shot sleeve to control the volume of a shot receiving portion. It is another feature of the invention that the shot cup base contains a combination of vertical apertures and horizontal apertures that cause the shot cup base sidewalls to petal outward after exiting the muzzle of a shotgun. Another feature is that reinforcing ribs run along the edges of the vertical apertures. Still another feature of the invention is that a top surface of the vertical apertures is spanned by a thin tab extending between petal portions.

Among the advantages of the invention are that the combination of shot sleeve and shot cup base provide precise control of the shot receiving portion volume of a shot shell and the shot are securely retained by a crimp formed across the open end of the shot shell. Other advantages of the shot cup base of the invention include considerable aerodynamic resistance on exiting the muzzle of the shotgun to avoid interfering with the shot string flight pattern and that the shot cup base is sufficiently robust to maintain its shape during handling and insertion into the shot sleeve.

Another advantage of the invention is that it eliminates the need for a large number of wads dedicated to a specific shot weight load. This reduces capital expenditures for wad tooling, reduces inventory requirements and simplifies loader setup and change over.

In accordance with the invention there is provided a combination shot sleeve and shot cup base. The shot sleeve is a first tubular member having an open end and closed end. An inside wall of this first tubular member has a first substantially smooth portion adjacent to the open end and a second substantially smooth portion adjacent to the closed end. A plurality of substantially parallel, inwardly projecting, first ribs circumscribe this inside wall and are disposed between the first and second smooth portions.

The shot cup base is a second tubular member having an open end and a closed end. A plurality of substantially parallel, outwardly protruding, second ribs circumscribe an outside wall of this second tubular member. A plurality of apertures extend through sidewalls of the second tubular member. The shot cup base is sized to be received within the shot sleeve with the first ribs and the second ribs being intermeshed.

The above stated objects, features and advantages will become more apparent from the specification and drawings that follow.

IN THE DRAWINGS

DETAILED DESCRIPTION

Figure 1:
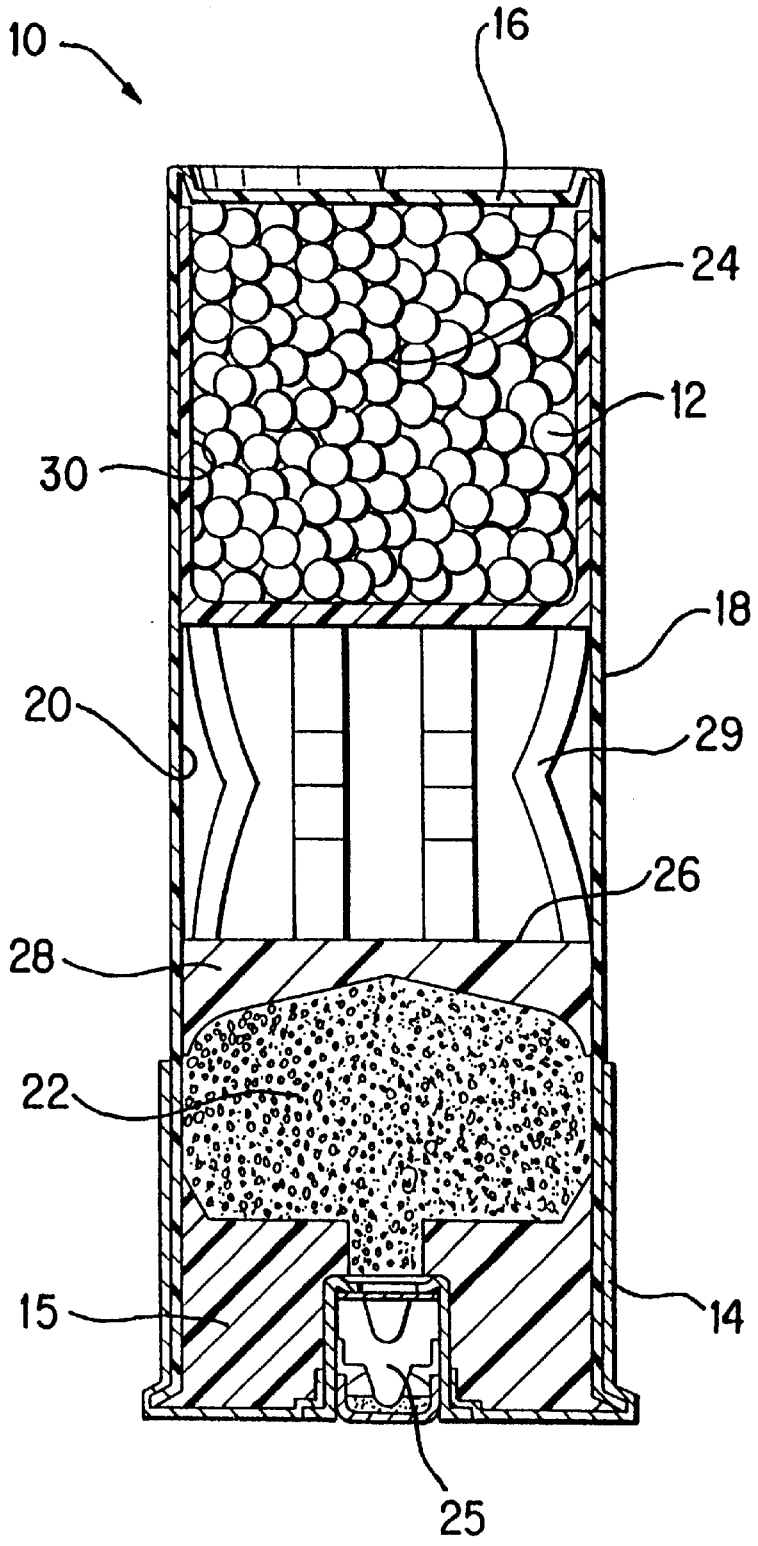
FIG. 1 PRIOR ART
FIG. 1 illustrates in cross sectional representation a shot shell as known from the prior art.

FIG. 1 illustrates a shot shell 10 intended to expel a plurality of shot 12 from the muzzle of a shotgun as known from the prior art. The shot shell 10 has a base end sealed by a base that is typically formed from a brass or brass plated steel head 14, and a plastic or paper basewad 15, and a forward end sealed by a crimp 16 or a closure disk (not shown). A tubular husk 18, typically formed from extruded high density polyethylene, forms the body of the shot shell 10. A volume contained within the shot shell 10 and defined by brass head 14, basewad 15, interior walls 20 of tubular husk 18, and the crimp 16 is divided into a first volume portion 22 that contains a propellant and second volume portion 24 that contains the shot 12.

When percussive primer 25 is struck by the firing pin of a shotgun, the resultant flash ignites the propellant generating the force to expel the shot 12 from the shotgun muzzle.

A shot wad 26 separates the first volume portion 22 from the second volume portion 24. The shot wad 26 typically includes an over powder cup 28 that in combination with brass head 14, basewad 15 and interior walls 20 contains the propellant. A shot cup 30 portion of the shot wad 26, in combination with the crimp 16, contains the shot 12.

The volume of shot and powder in combination with the volume of the over powder cup and the shot cup do not completely fill up the available shot shell volume for most loads. To fill this excess volume and create a snug load fit, the shot wad contains a compressible region 29 between the shot cup 30 and the over powder cup 28. This intermediate section is typically highly compressible to provide adjustment capabilities for the load fit. The compressible region 29 also cushions the shot against the initial shock of ignition and helps to reduce peak pressures by increasing the available volume as it collapses in the initial stages of powder ignition.

The volume of propellant will vary with different loads and the density of the propellant used. Different shot weight loads will vary the shot column volume. Minor variations in load volume requirements can be adjusted for by the degree of compression of the collapsible region 29 of the wad. Loads of different shot weights require a new shot wad size to achieve a good load fit. The need for numerous wad sizes complicates loading equipment setup and change over, increases inventory requirements and increases cost by requiring more capital expenditure for tooling to produce the many wad sizes and reducing the efficiencies of volume pricing offered by the purchase of a few standard components.

A better approach is the universal shot wad of the invention that effectively provides an adjustable shot receiving volume capable of accommodating a wide range of shot weight loads. For example, the two piece universal wad system described below can accommodate shot weights, in ounces, of ⅞, 1, 1⅛, 1¼, 1½ and 1⅝ in 12 gauge 2¾ inch shot shells. It is equally effective for many 12 gauge 2¾ inch buckshot loads. The space between the bottom of the shot cup base and the top of the powder cup forms a compressible section to cushion the shock of powder ignition and to reduce peak pressures. The same concept can be extended to 3 and 3½ inch loads with the same shot cup base and an appropriately sized shot sleeve. The concept can also be applied to 10, 16, 20, 28 and 410 gauge shot shell loads.

Figure 2:
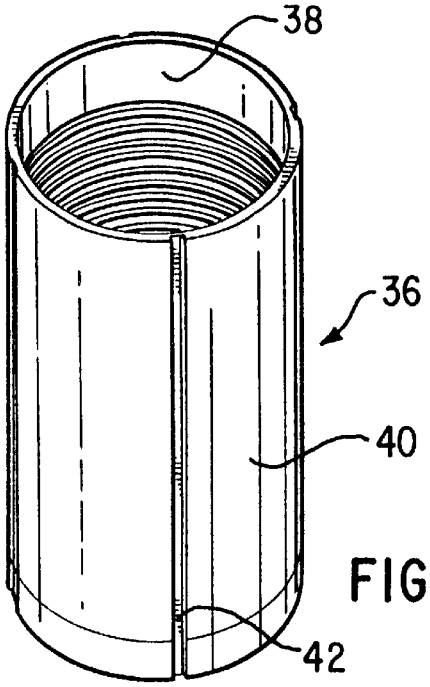
FIG. 2 is a side perspective view of a shot sleeve utilized in the combination of the invention.

The present invention overcomes the problem of the prior art by utilizing a combination shot sleeve and shot cup base. The shot sleeve 36 is illustrated in front planer view in FIG. 2. The shot sleeve 36 is a first tubular member formed from an injection moldable polymer, and preferably from high density or medium density polyethylene The first tubular member 36 has an inside wall 38 and an outside wall 40. A plurality of narrow channels 42 extend inward from outside wall 40 without contacting inside wall 38. The channels 42 extend longitudinally for the length of shot sleeve 36 to vent air trapped in the shell as the wad is inserted.

Figure 3:
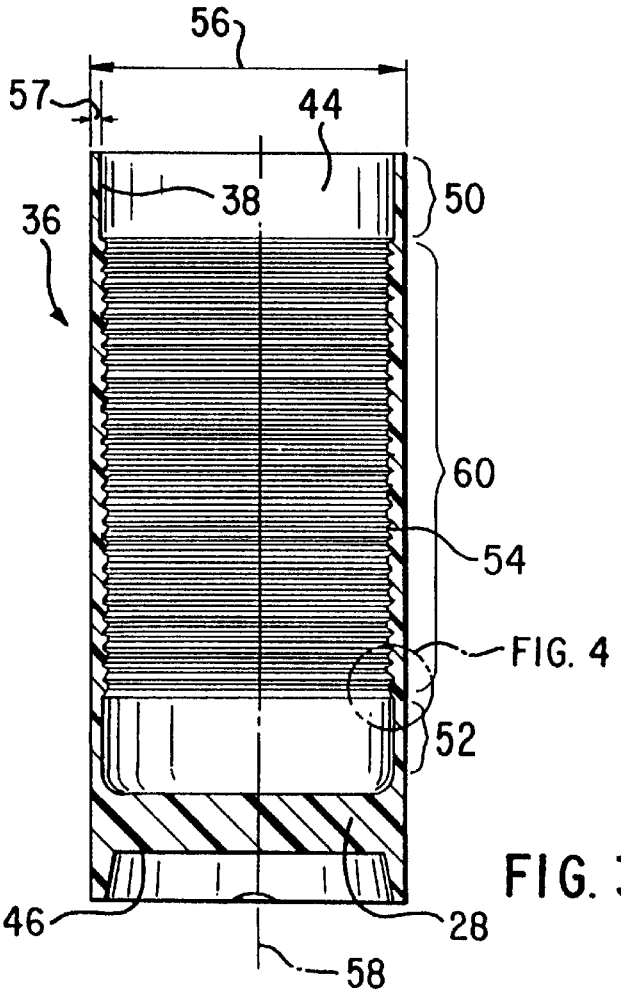
FIG. 3 illustrates in cross sectional representation a first embodiment of the shot sleeve of FIG. 2.

FIG. 3 illustrates the shot sleeve 36 in cross sectional representation. The shot sleeve 36 has an open end 44 and a closed end 46. The closed end 46 forms an over powder cup portion 28.

The inside wall 38 has a first substantially smooth portion 50 that is adjacent to the open end 44 and a second substantially smooth portion 52 that is adjacent to the closed end 46. Disposed between the first substantially smooth portion 50 and the second substantially smooth portion 52 are a plurality of substantially parallel, inwardly projecting, first ribs 54. The first ribs 54 are annular and circumscribe the inside wall 38.

For a typical twelve gauge shot shell, the husk has an inside diameter of about 0.744 inch. A shot sleeve 36 intended to be inserted into a twelve gauge shot shell has an outside diameter 56 of between about 0.725 inch and 0.750 inch and, preferably, the outside diameter 56 is from about 0.733 inch to about 0.743 inch. The thickness 57 of the wall of the shot sleeve 36 at the smooth portions is between about 0.02 inch and 0.03 inch and, preferably, from about 0.023 inch to about 0.025 inch.

The lengths of the first substantially smooth portion 50 and of the second substantially smooth portion 52, as measured along longitudinal axis 58, are both from about 0.2 inch to about 0.25 inch and, preferably, from about 0.215 inch to about 0.225 inch. A mid-portion 60 containing first ribs 54 has a length from about 0.8 inch to about 1.2 inch, more preferably from about 0.9 inch to about 1.1 inch and, most preferably, from about 1.0 inch to about 1.1 inch.

Figure 4:
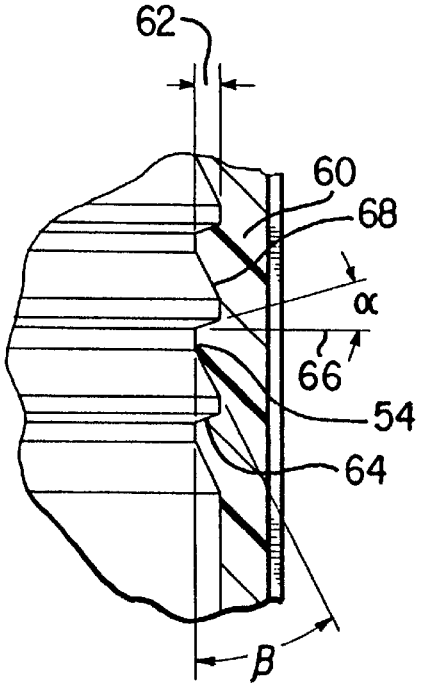
FIG. 4 is a magnified view of a portion of the shot sleeve of FIG. 2 illustrating a plurality of substantially parallel, inwardly projecting, ribs.

As best illustrated in FIG. 4, a magnified view of reference circle 4, the first ribs 54 protrude inwardly from the wall of mid-portion 60 by a distance 62 of from about 0.005 inch to about 0.015 inch and, preferably, from about 0.09 inch to about 0.011 inch. An upwardly facing surface 64 of first ribs 54, defined herein as the surface facing open end 44 (of FIG. 3) forms an angle a relative to a radial axis 66, that is perpendicular to the longitudinal axis (58 of FIG. 3), of between about 10° and about 20° and preferably from about 13° to about 17°. A downwardly facing surface 68 of first ribs 54, defined herein as the surface facing towards closed end (46 of FIG. 3), forms an angle β relative to the longitudinal axis (58 of FIG. 3) of from about 20° to about 40°, more preferably from about 25° to about 35° and, most preferably, from about 28° to about 32°.

Forming upwardly facing surface 64 with a relatively gentle slope creates a high degree of engagement between the sleeve and the shot cup base which keeps the shot cup base securely in position. Forming downwardly facing surface with a relatively steep slope assists in accurate engagement of the shot cup base into the shot sleeve and eases ejection from a core during the injection molding process.

Figure 5:
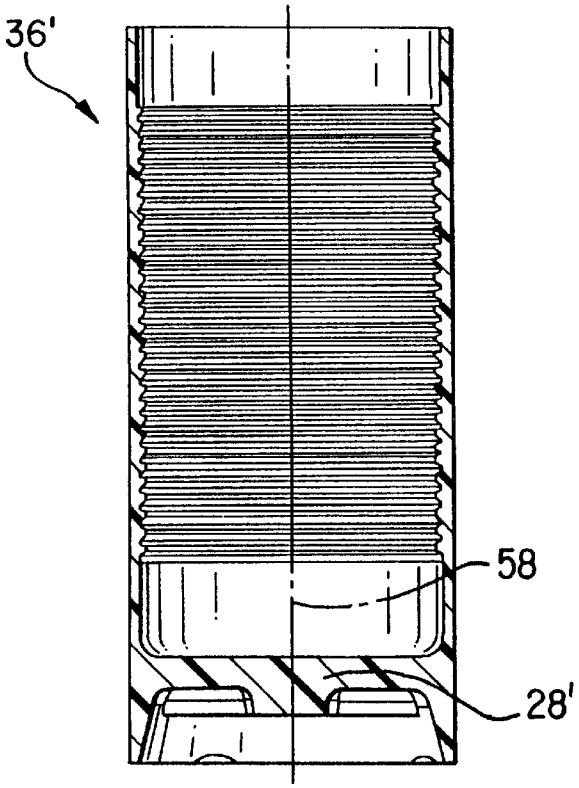
FIG. 5 illustrates in cross sectional representation a second embodiment of the shot sleeve of the invention.
Figure 6:
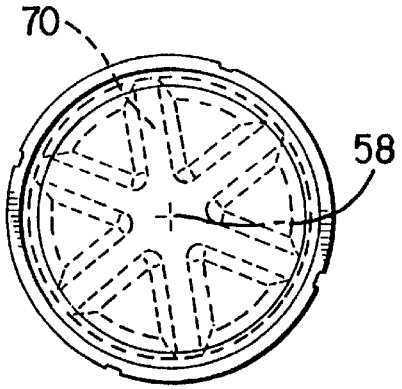
FIG. 6 illustrates in bottom planar view the shot sleeve of FIG. 5.

An alternative shot sleeve 36' is illustrated in cross sectional representation in FIG. 5. The over powder cup 28' includes reinforcing ribs 70 that, as illustrated in FIG. 6, extend radially outward from longitudinal axis 58.

Figure 7:
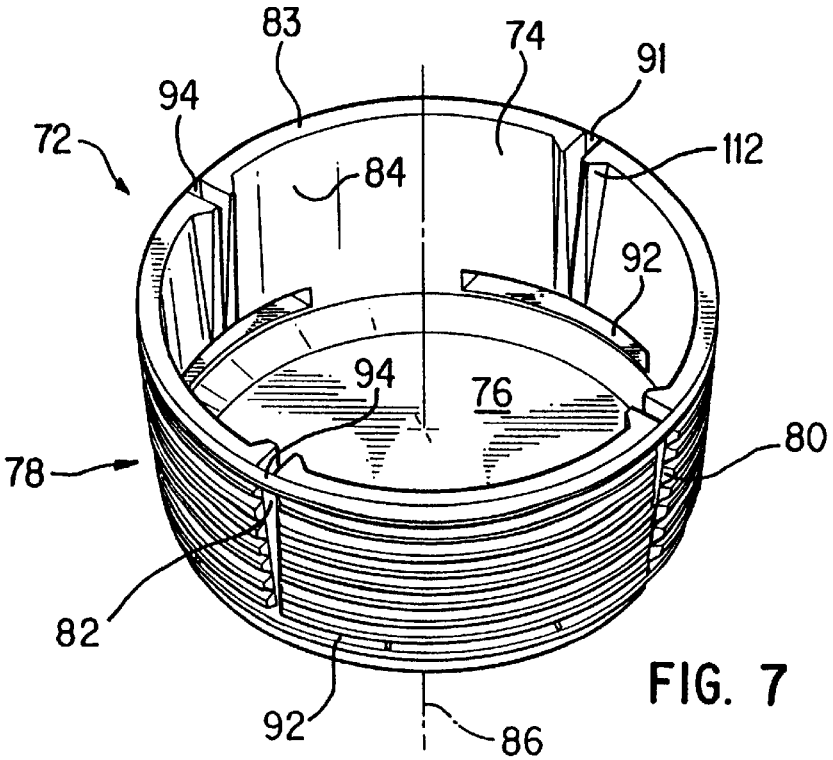
FIG. 7 is a side top perspective view of a first embodiment of the shot cup base utilized in the combination of the invention.

The second half of the combination of the invention is a shot cup base. A first embodiment of the shot cup base 72 is illustrated in front perspective view in FIG. 7. The shot cup base 72 is a second tubular member and has an open end 74 and an opposing closed end 76. An outer wall 78 contains a plurality of substantially parallel, outwardly protruding, annular second ribs 80. The shot cup base 72 is manufactured from any suitable, injection moldable, polymer, such as a high density polyethylene.

Vertical apertures 82 extend through sidewalls 83 of the shot cup base 72 dividing the sidewall into several section. The vertical apertures 82 have a long axis that runs generally parallel to a longitudinal axis 86 of the shot cup base 72 and a short axis that is generally perpendicular to the longitudinal axis 86.

Along the longitudinal axis 86, a first end of the vertical apertures 82 extends to a point proximate to the open end 74 of the shot cup base 72. An opposing second end extends to a point proximate to the closed end 76. Preferably, the first end terminates at the open end 74 as opening 91 and the second end terminates adjacent to a horizontal aperture 92. More preferably, the second end intersects the horizontal aperture 92 forming a continuous aperture.

Most effectively, the vertical apertures 82 are symmetrically disposed around the circumference of the shot cup base 72 and more preferably, there are four longitudinal apertures disposed 90° apart around the circumference of the shot cup base 72.

When the shotgun is fired, shot cup base 72 is expelled from the muzzle along with the shot. The resistance of air to the travel of the shot cup base 72 generates a force effective to rupture tabs 94 causing the shot cup sidewall sections or portions to separate. Horizontal apertures 92, having a long axis that is generally perpendicular to longitudinal axis 86, increase the flexibility of the sidewall portions following rupture of the tabs 94 such that the force of the air resistance is effective to cause the sidewall portions to petal outward increasing aerodynamic resistance and causing the shot cup base 72 to slow down and separate from the shot string.

The vertical apertures 82 are of a shape effective to enable the vertical edges of the sidewall portions to uniformly abut each other and to support vertical edges of adjacent sidewall portions when the shot cup base 72 is inserted into the shot sleeve forming the shot cup base into a cylindrical shape. Forming uniform cylindrical interengagement of the first ribs of the sleeve with the second ribs of the shot cup base is necessary to maximize the engagement force and assure stable positioning of the shot cup base.

Figure 9:
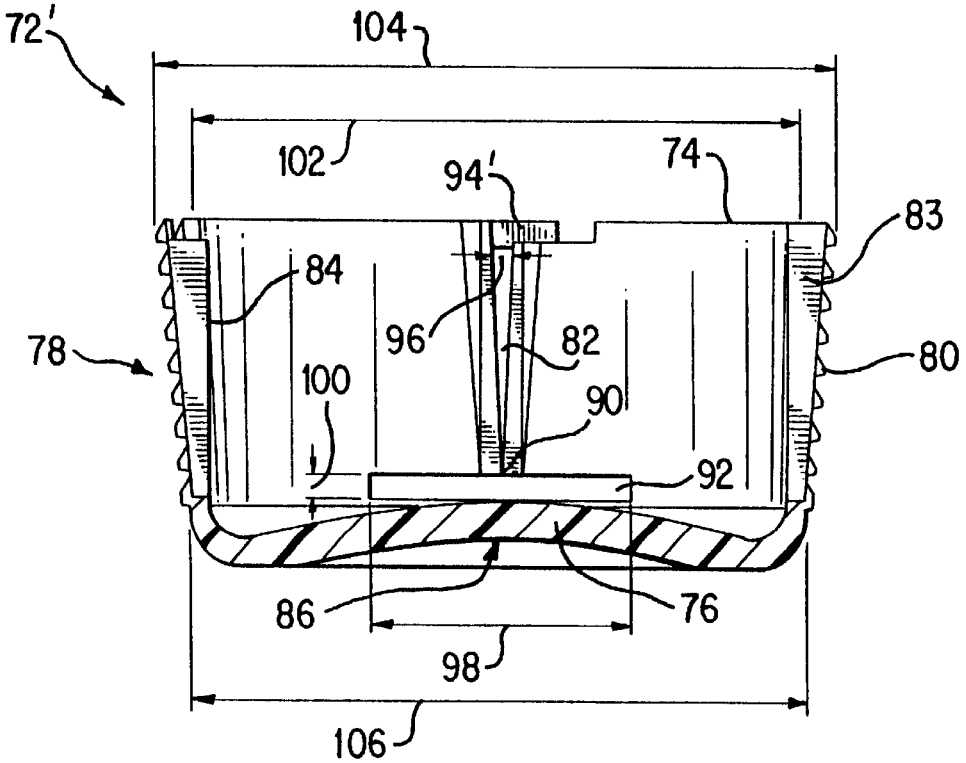
FIG. 9 is a cross sectional view of the shot cup base of FIG. 8.

As shown for base 78' in FIG. 9, one preferred shape for the vertical apertures 82 is a triangle. An exemplary triangle has a base width 96 of from about 0.040 inch to about 0.060 inch and more preferably from about 0.045 inch to about 0.055 inch.

Horizontal aperture 92 may be any desired shape such as a rectangle or an ellipse. An exemplary horizontal aperture 92 has a long axis length 98 of from about 0.20 inch to about 0.40 inch, preferably from about 0.25 inch to about 0.35 inch and most preferably from about 0.28 inch to about 0.32 inch. The short axis length 100 is preferably from about 0.02 inch to about 0.04 inch and more preferably to about 0.028 inch to about 0.032 inch.

The apex 90 of the vertical aperture 82 terminates adjacent to the 15 horizontal aperture 92. Preferably, the apex 90 intersects the horizontal aperture such that the sidewalls 83 are pierced substantially from the closed end 76 to the open end 74 of the shot cup base 72'. Tabs, such as tabs 94' that extend from the second ribs 82, prevent premature segmenting of the shot cup base 72' and entanglement with other shot cup bases in bulk packaging.

The inside diameter 102 of the shot cup base 72' is tapered over substantially the entire portion of inside wall surface 84 opposite second ribs 80. The taper matches a taper formed on the outer wall surface 78 to generate a substantially uniform wall thickness that, in preferred embodiments, is about 0.02 inch. The outside diameter is tapered having a open end outside diameter 104 of between about 0.75 inch and about 0.79 inch and preferably from about 0.760 inch to about 0.770 inch. A closed end outside diameter 106 is from about 0.665 inch to about 0.705 inch and, preferably, from about 0.680 inch to about 0.690 inch.

The tapered surface of the shot cup base 72' facilitate insertion into the shot sleeve. Since the open end outside diameter 104 is larger than the inside diameter of the shot sleeve, the shot cup is compressed when inserted into the shot sleeve forming a cylindrical shape and developing an interference fit against the inside walls of the shot sleeve to ensure tight interengagement.

With reference back to FIG. 7, vertical ribs 112 prevent the edges of the respective sidewall portions from overlapping. Such overlap would significantly reduce the interengagement force and result in possible movement of the shot cup base during the crimping operation in loading producing unacceptable sunken crimps and loose load fit.

The tabs 94 at the top of vertical apertures 82 adjacent to the open end 74 increase the robustness of the shot cup base. Robustness is required to ensure that shot cup base does not break or deform during handling or in the loading operation.

Figure 11:
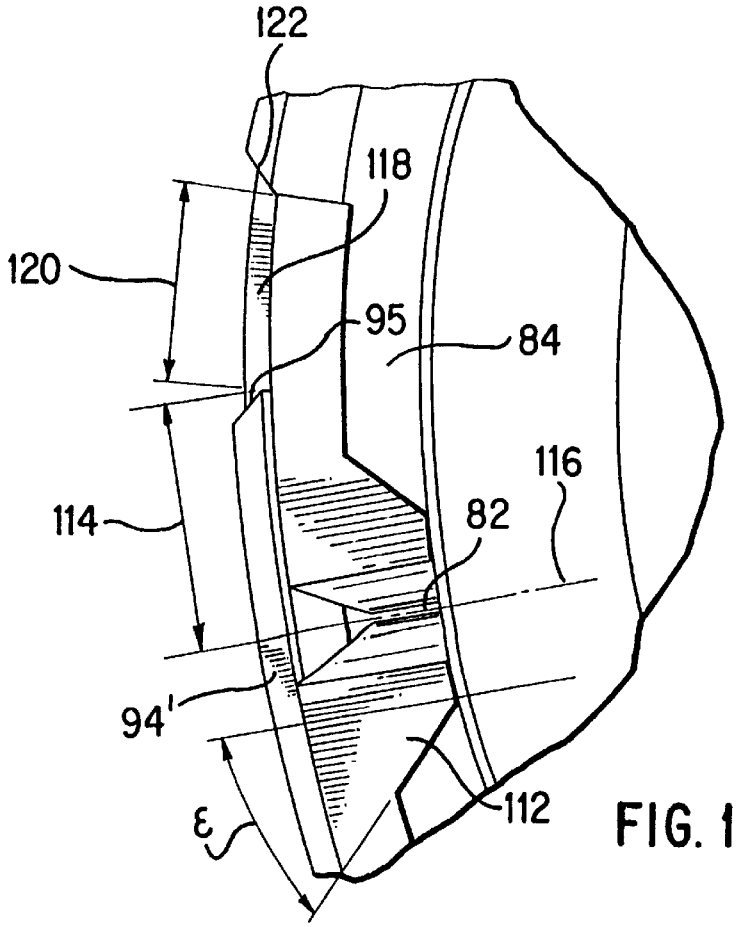
FIG. 11 illustrates in top planar view a reinforcing tab bridging a vertical aperture extending through the shot cup base of FIG. 8.

As illustrated in FIG. 11, tab 94' projects from at least one of the second ribs 80 and, preferably, projects from the top-most second rib, that second rib adjacent to the open end. The thickness of the tab 94' is about equal to the thickness of a second rib 80, on the order of from about 0.008 inch to about .012 inch. The tab 94' spans the vertical aperture 82 and terminates a distance 114 beyond a center line 116 of vertical aperture 82. By preventing the sidewall portions of the shot cup base from segmenting, the tabs 94' provide required robustness to the shot cup prior, and during, loading.

Figure 10:
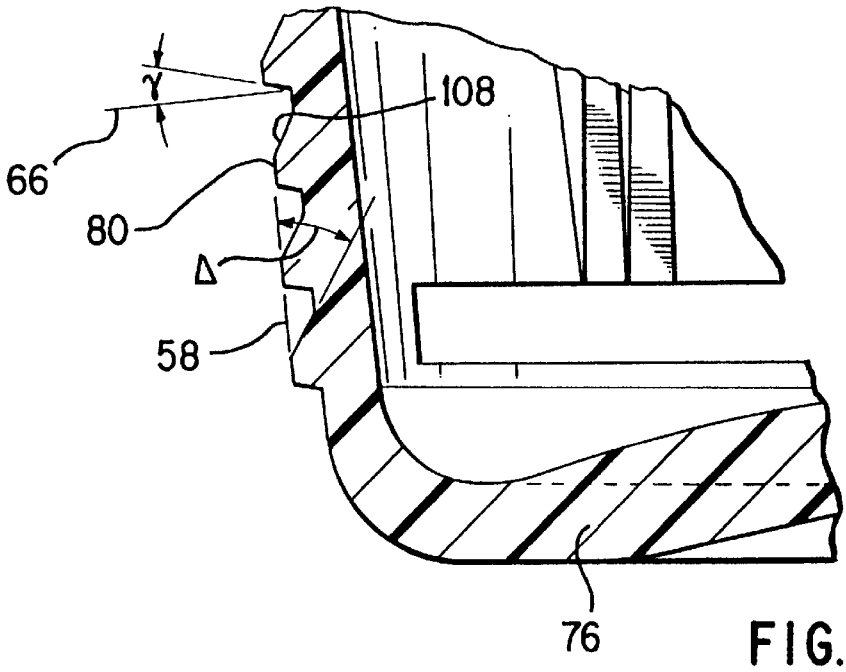
FIG. 10 is a magnified view of a portion of the shot cup base of FIG. 8 illustrating a plurality of substantially parallel, outwardly protruding, second ribs.

FIG. 10 is a magnified cross sectional view of a portion of the shot cup base 72' illustrating second ribs 80 having a downward facing side forming an angle $\gamma$ of from about 10° to about 20° relative to radial axis 66 and, preferably, forming an angle of between 13° and 17°. An upwardly directed face 108 forms an angle $\Delta$ of between 20° and 40° relative to longitudinal axis 58. More preferably, the angle $\Delta$ is between about 28° and about 32°. The upwardly directed faces of the second ribs 80 have a relatively gentle slope to create a high degree of engagement between the sleeve and the shot cup base which keeps the shot cup base securely in position. The downwardly directed faces have a relatively steep slope to assist with accurate engagement of the shot cup base into the shot sleeve.

The closed end 76 of the shot cup base has an inwardly convex surface to recess any gate vestige from the injection molding operation that could adversely affect feeding in an automated loading operation.

While the vertical apertures and horizontal apertures provide the shot cup base with flexibility enabling the sidewall portions to segment on expulsion from the shotgun muzzle, a second feature of the shot cup base is sufficient rigidity to resist deformation during handling and insertion into the shot sleeve. Referring back to FIG. 7, each vertical aperture 82 is bordered on the inside wall 84 with an inwardly projecting reinforcing rib 112. The reinforcing ribs 112 maintain the shot cup base in a cylindrical shape when inserted into the shot sleeve by preventing adjacent edges of sidewall portions from overlapping. By preventing overlap, high interengagement forces are maintained.

The reinforcing ribs 112 are tapered and project inward by about from about 0.023 inch to about 0.027 inch adjacent to the open end 74 and are substantially flush with inner wall 84 at the apex 90. The inward projection of the reinforcing ribs provides a wider bearing surface for the vertical apertures to maintain the optimum cylindrical shape on insertion into a shot sleeve. The inward projection also prevents the shot cup bases from nesting within each other in bulk packaging and during handling and feeding. If nesting were to occur, it would create severe feeding problems for automated loading equipment. Tapering the reinforcing ribs facilitates ejection of the shot cup base from the injection mold.

As illustrated in FIG. 11, the reinforcing ribs 112 extend inward from inner wall 84 forming an angle e relative to the radial axis of between about 40° and about 50° and, preferably, form an angle of about 45°.

Figure 8:
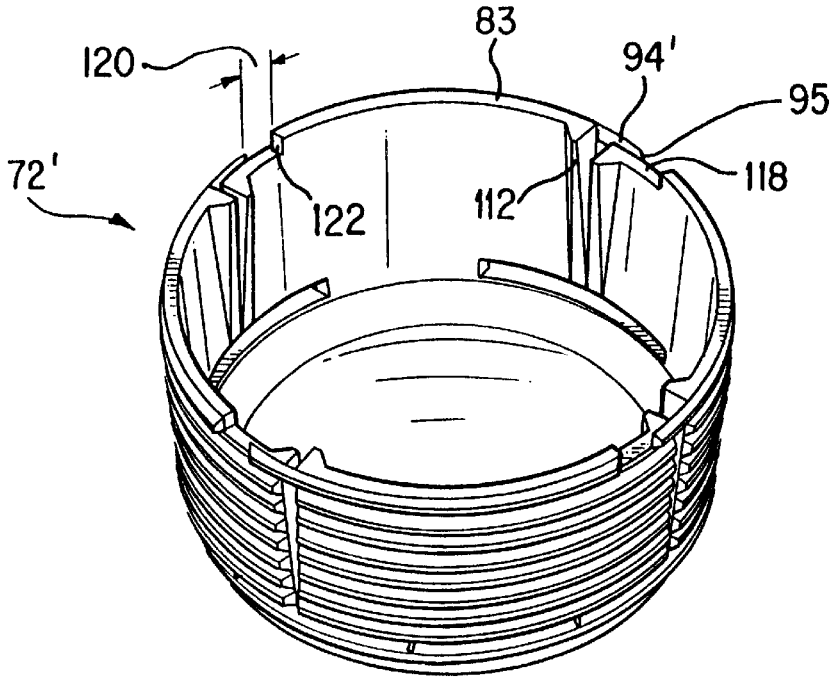
FIG. 8 is a side top perspective view of a second embodiment of the shot cup base utilized in the combination of the invention.

In the second embodiment of the base 72' of the invention, as illustrated in FIG. 8, breaking of the tabs 94' following expulsion from the muzzle of the shotgun is facilitated by a notch 118 extending into the sidewall 83 from a reinforcing rib 112. The length 120 of the notch 118, as measured from a termination end 95 to top-most rib initiation point 122, is from about 0.045 inch to about 0.06 inch and, more preferably, for a distance of from about 0.05 inch to about 0.055 inch. The notch 118 has a depth of between about 0.020 inch and 0.030 inch and, preferably, from about 0.021 inch to about 0.024 inch. The base 72' may be otherwise similar to the base 72.

A chamfer, as seen in FIG. 11, at the end of notch 118 opposite from termination end 95 has an angle of from about 40° to about 50° relative to the radial axis of the shot cup. The purpose of this chamfer is to accommodate injection mold cam actions.

Figure 12:
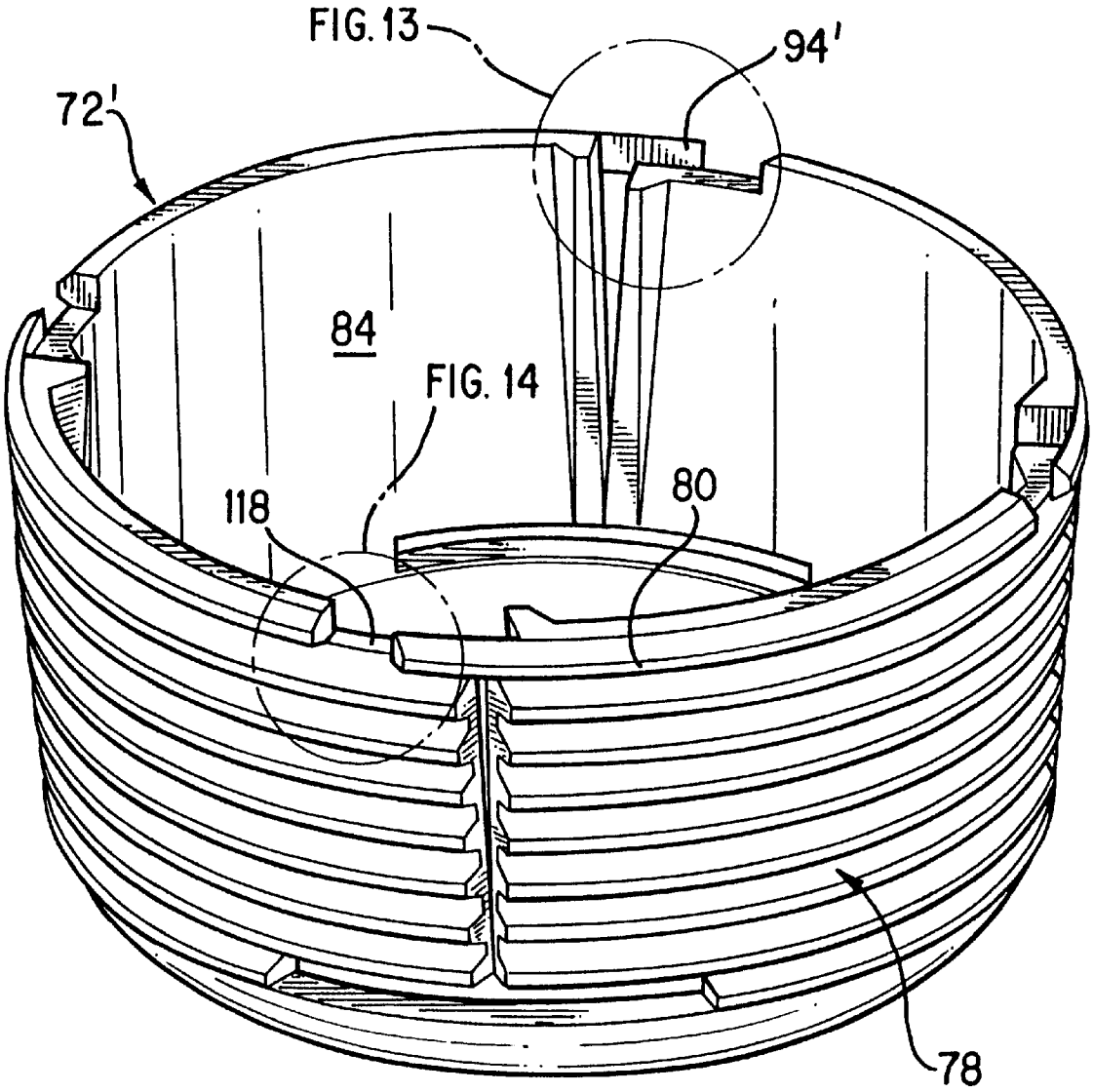
FIG. 12 illustrates in front perspective view the shot cup base of the invention.
Figure 13:
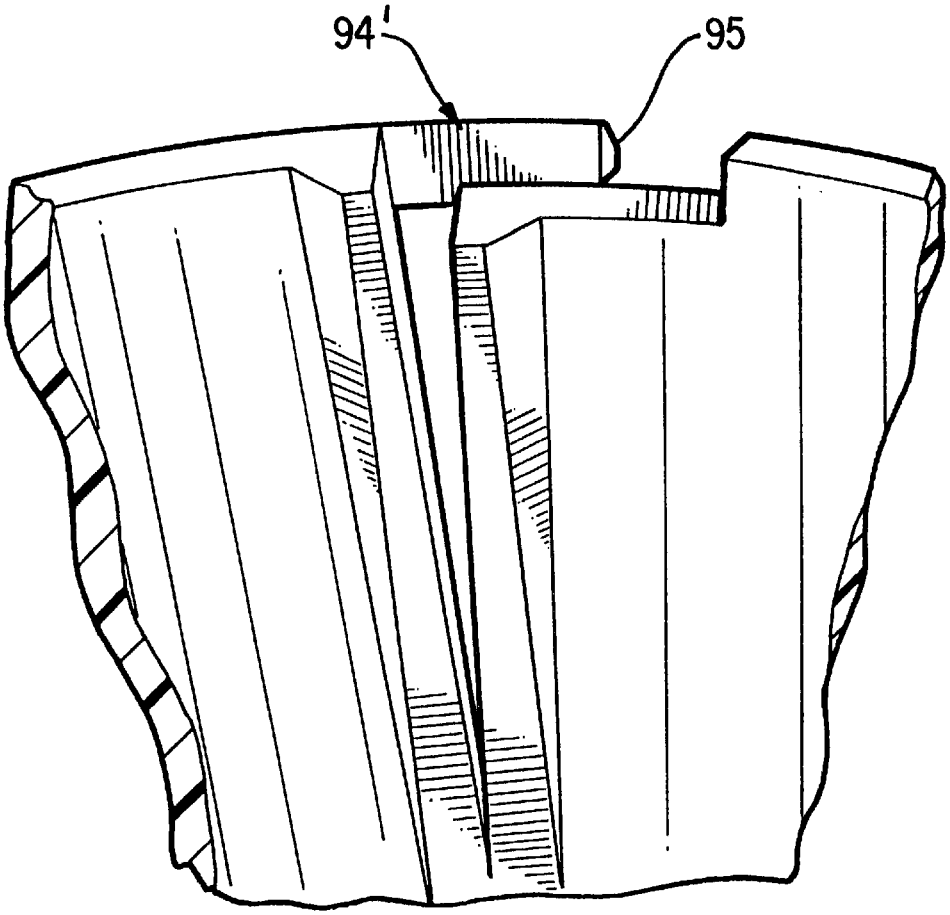
FIG. 13 illustrates in magnified front perspective view a reinforcing tab bridging a vertical aperture formed through a sidewall of the shot cup base of the invention.
Figure 14:
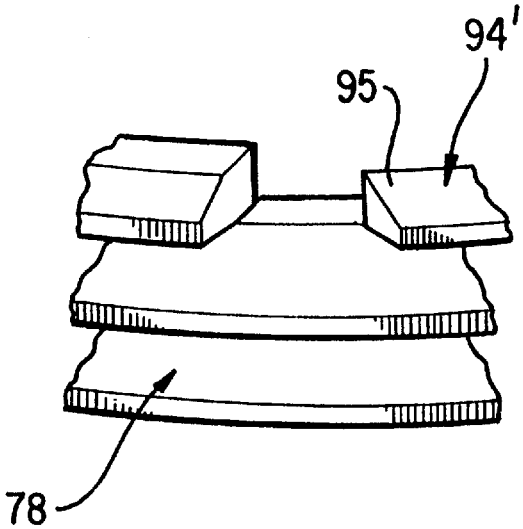
FIG. 14 illustrates in magnified front perspective view a termination portion of the reinforcing tab of the shot cup base of the invention.

The functions of the tab 94' and the notch 118 is illustrated in FIGS. 12 through 14. FIG. 12 is a perspective view of the shot cup base 72 with FIG. 13 being a magnified view of the tab 94' viewed from an inner wall 84 of the shot cup base 72 and FIG. 14 a magnified view of the notch 118 viewed from an outside wall 78.

Tab 94' extends from second rib 80, rather than from the body of the shot cup base 72. Since this is a molded polymer part, tab 94 is unitary with the body of the shot cup, however the web, that portion of the termination end 95 of tab 94 contacting the body is minimal. Typically, the cross sectional area of the web is from about 0.0005 square inch to about 0.002 square inch.

FIG. 14 further illustrates termination end 95 of tab 94' contacting the outer wall 78 of the shot cup base.

Figure 15:
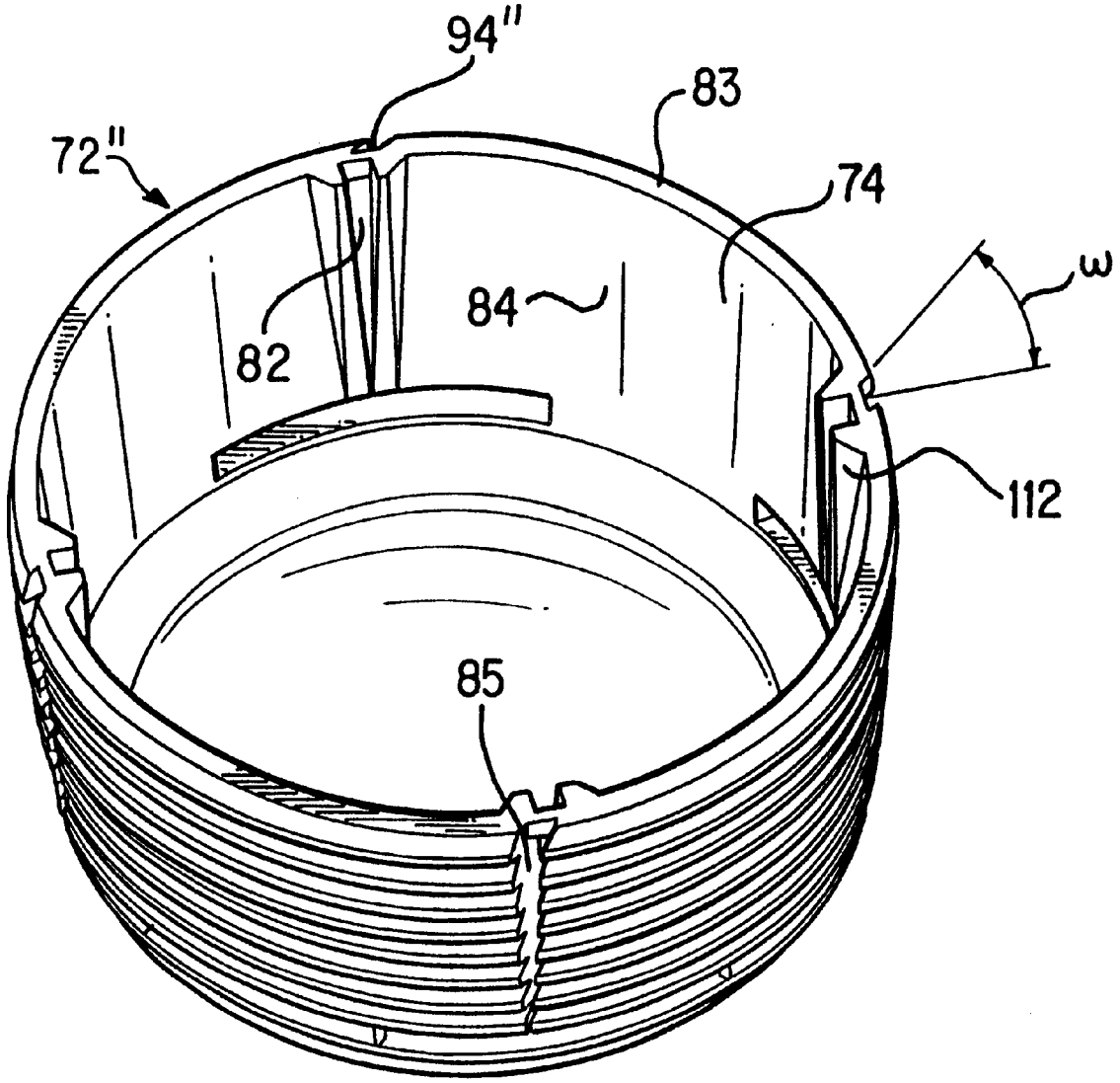
FIG. 15 is a side top perspective view of a third embodiment of the shot cup base utilized in the combination of the invention.

In a third embodiment of the invention, as illustrated in FIG. 15, tabs 94" connect between the portions of sidewall 83 from the open end 74 within vertical apertures 82 flush with the inside 84 of sidewall 83. The thickness of tabs 94' is from about 0.005 inch to about 0.015 inch and, preferably, from about 0.008 inch to about 0.012 inch. The height of the tabs 94" is from about 0.01 inch to about 0.03 inch and, preferably, from about 0.015 inch to about 0.025 inch.

Another aspect of this embodiment is angled surfaces 85 within the apertures. The angle, ω, which starts along the edge of the vertical reinforcing ribs 112 at the plane of the inside 84 of sidewall 83 is between about 40° and about 50° and, preferably, about 45°. The angled surfaces of the vertical apertures form surfaces that uniformly abut when the shot cup base is inserted into the shot sleeve. These features enable standing steel on the cores of the injection mold to be moved to the cams. The absence of standing steel on the core allows the use of stripper plate action in an injection mold. This provides very reliable ejection of the part from the mold which is critical for economical, high speed, high volume injection molding.

It is apparent that there has been provided in accordance with the present invention a shot cup that in combination with a shot sleeve forms a universal shot wad that fully satisfies the objects, means and advantages set forth herein above. While the invention has been described in combination with embodiments thereof, it is evident that many alternatives, modifications and variations will be apparent to those skilled in the art in light of the foregoing description. Accordingly, it is intended to embrace all such alternatives, modifications and variations as fall within the spirit and broad scale of the appended claims.

I claim:

1. A combination shot sleeve and shot cup base, comprising:

said shot sleeve being a first tubular member having an open end and a closed end, an inside wall of said first tubular member having a first substantially smooth portion adjacent to said open end and a second substantially smooth portion adjacent to said closed end with a plurality of substantially parallel, inwardly projecting, first ribs circumscribing said inside wall and disposed between said first and second smooth portions; and said shot cup base being a second tubular member having an open end and a closed end thereof, a plurality of substantially parallel, outwardly protruding, second ribs circumscribing an outside of a sidewall of said tubular second member, and a plurality of apertures extending through said sidewall each of said apertures comprising a vertical aperture and an adjacent horizontal aperture;

wherein said shot cup base is sized to be received within said shot sleeve with said first ribs and said second ribs intermeshed, said shot cup base having a length which is less than a length of said shot sleeve.

2. The combination of claim 1 wherein each of said vertical apertures extends from proximate to said open end to proximate to said closed end and separates adjacent sections of the sidewall.

3. The combination of claim 2 wherein said vertical apertures are disposed generally symmetrically about said shot cup base.

4. The combination of claim 3 wherein there are four of said vertical apertures.

5. The combination of claim 3 wherein a first end of each of said vertical apertures terminates at said open end and second end terminates adjacent to said adjacent horizontal aperture.

6. The combination of claim 5 wherein each of said vertical apertures has a pair of vertical sides and an associated reinforcing rib borders each of the vertical sides.

7. The combination of claim 6 wherein each said reinforcing rib is tapered and thicker adjacent to said open end and thinner adjacent to said closed end.

8. The combination of claim 7 wherein each said vertical rib inwardly projects for a distance of from about 0.023 inch to about 0.027 inch adjacent to said open end and is substantially flush with said sidewall adjacent to said closed end.

9. The combination of claim 7 wherein each of said vertical apertures is triangular in shape with a base adjacent to said open end and an apex intersecting said horizontal aperture.

10. The combination of claim 9 wherein said vertical aperture base has a width of from about 0.045 inch to about 0.055 inch.

11. The combination of claim 5 wherein a tab extending from at least one of said second ribs spans each said vertical aperture.

12. The combination of claim 11 wherein said tab extends from the second rib adjacent to the open end.

13. The combination of claim 12 wherein said tab has a thickness of from about 0.008 inch to about 0.012.

14. The combination of claim 12 wherein a notch extends into said sidewall from said vertical notch to a distance beyond a termination end of said tab.

15. The combination of claim 14 wherein said notch extends into said sidewall for a depth of from about 0.02 inch to about 0.03 inch and said length from said termination end is from about 0.045 inch to about 0.06 inch.

16. The combination of claim 14 wherein said tab contacts said sidewall forming a web with an area of from about 0.0005 square inch to about 0.002 square inch.

17. The combination of claim 14 wherein said second ribs have an upwardly facing surface and a downwardly facing slope with said upwardly facing slope have a more gentle slope.

18. The combination of claim 5 wherein a tab extends between the associated adjacent sections of the sidewall at the open end of each of said vertical apertures flush with an inside of the sidewall.

19. The combination of claim 18 wherein said tab has a thickness of from about 0.008 inch to about 0.012 inch and a height of from about 0.015 inch to about 0.025 inch.

20. The combination of claim 9 wherein a pair of vertical surfaces within said vertical aperture extend at an angle of from about 40° to about 50° from adjacent inboard vertical surfaces of the vertical reinforcing ribs such that each pair of vertical surfaces within said vertical aperture are parallel and abut after insertion in the shot sleeve.

21. The combination of claim 1 wherein an outside diameter of said shot cup base is greater at said open end than at said closed end.

22. The combination of claim 18 wherein an outside diameter of said shot cup base is from about 0.75 inch to about 0.79 inch at said open end and from about 0.665 inch to about 0.705 at said closed end.

23. The combination of claim 5 wherein a tab extends between associated adjacent sections of the sidewall at the open end of each of said vertical apertures flush with an inside of the sidewall and deformable to allow each of the vertical apertures to compress so that adjacent sections of the sidewall abut after insertion of the shot cup base into the shot sleeve.

* * * * *